United States Patent [19]

Naas

[11] 3,960,340

[45] June 1, 1976

[54] WINCH DRUM PROVIDED WITH SIDE FLANGES AND A SEPARATE FLANGE

[75] Inventor: Erling Naas, Brattvag, Norway

[73] Assignee: A/S Hydraulik Brattvaag, Norway

[22] Filed: Nov. 13, 1974

[21] Appl. No.: 523,457

[30] Foreign Application Priority Data

Nov. 13, 1973 Norway ..... 4342/73

[52] U.S. Cl. ..... 242/117

[51] Int. Cl.[2] ..... B65H 75/18

[58] Field of Search ..... 242/117, 54 R, 129.62; 254/186

[56] References Cited

UNITED STATES PATENTS

| | | | |
|---|---|---|---|
| 2,973,941 | 3/1961 | Lunde | 254/186 |
| 3,113,739 | 12/1963 | Elder | 242/54 R |
| 3,120,355 | 2/1964 | Bowman | 242/54 R |

*Primary Examiner*—Leonard D. Christian
*Attorney, Agent, or Firm*—Watson Leavenworth Kelton & Taggart

[57] ABSTRACT

A winch drum provided with side flanges and a separating flange arranged between two adjacent drum parts, to transfer a hawser from one part of the drum to the other. Said hawser is arranged to be stored in one or more layers on one part of the drum whereas a tensioned part of the hawser is arranged to be wound on to and wound off from the other part of the drum. A groove-carrying circular disc or disc section is located on the separating flange to form a smooth guiding member for the hawser when this is passed from one drum part to the other. In one embodiment the disc or disc section is allowed to pivot or oscillate in order to reduce friction on the hawser when passing from one drum part to the other.

3 Claims, 6 Drawing Figures

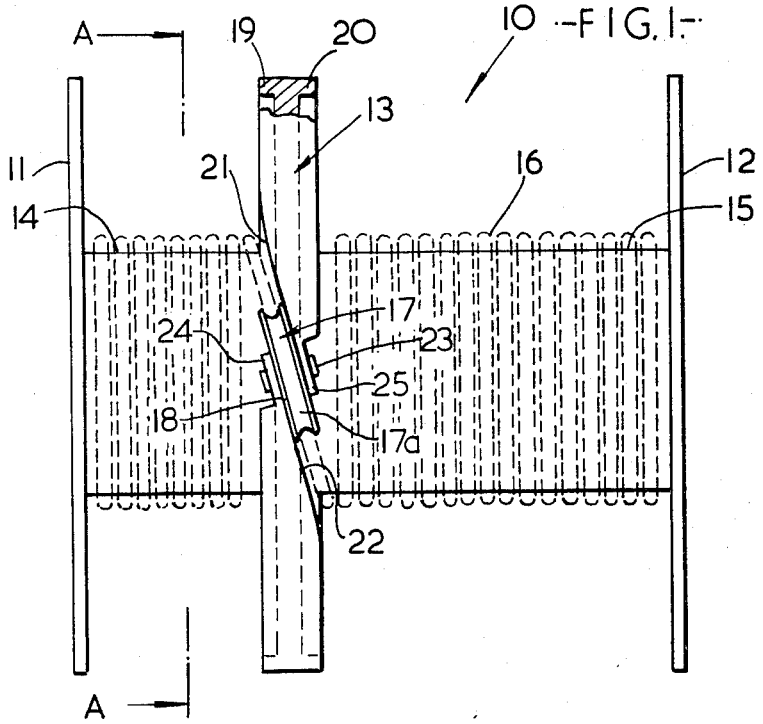
-FIG. 1-
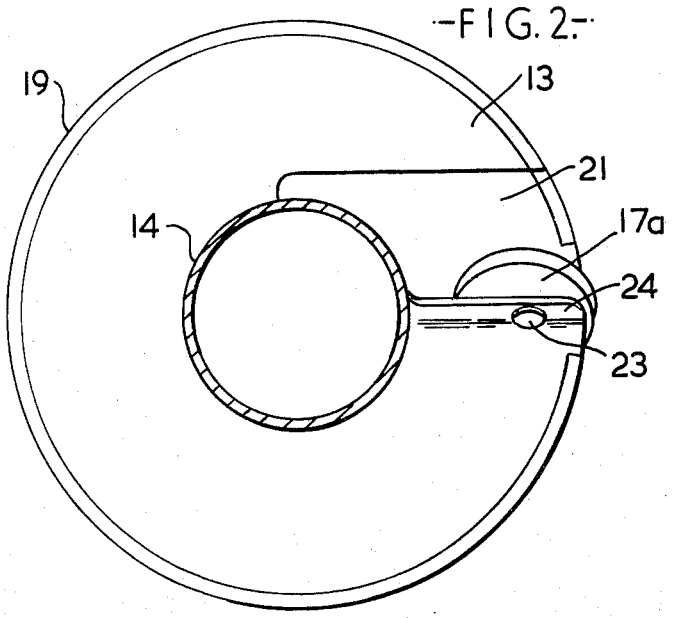
-FIG. 2-

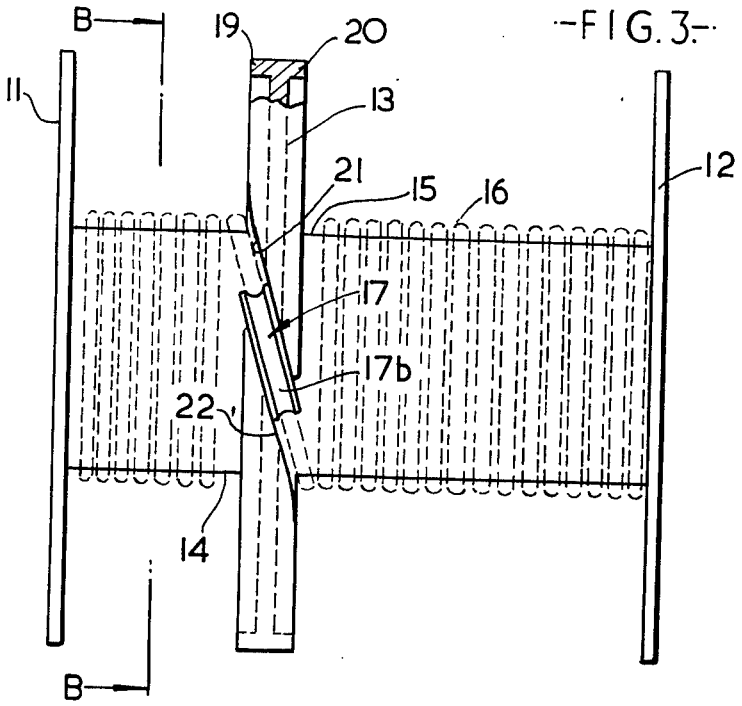
--FIG. 3--
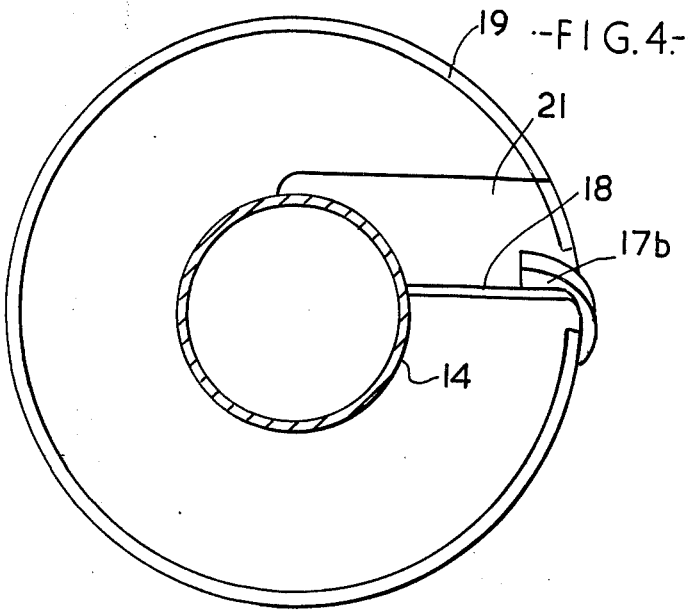
--FIG. 4--

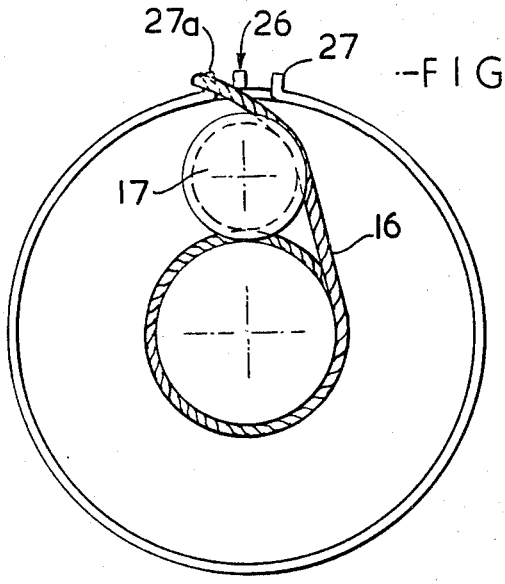
-FIG. 5-
-FIG. 6-
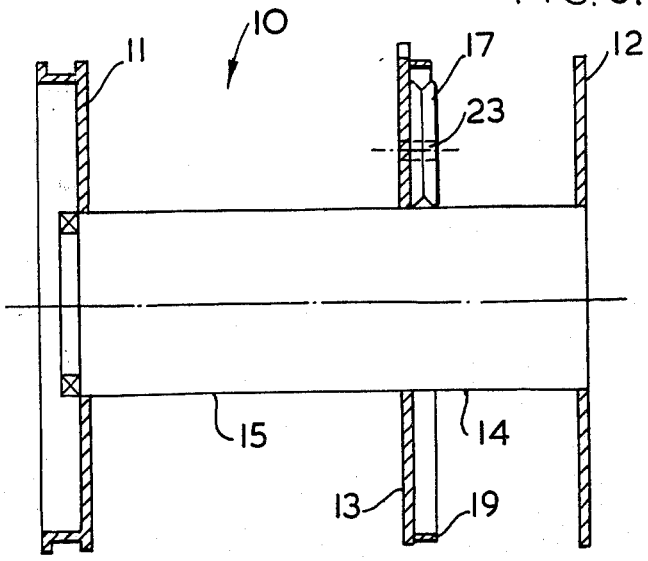

WINCH DRUM PROVIDED WITH SIDE FLANGES AND A SEPARATE FLANGE

The present invention relates to a winch drum provided with side flanges and a separating flange arranged between two adjacent drum parts, to transfer a line or hawser from one part of the drum to the other.

A winch drum provided with side flanges and a separating flange with a slot provided therein have been in use for a long time. A winch drum of this type is known, from U.S. Pat. No. 1,218,898, since 1917, and later on a lot of further improvements has been suggested based on such type of winch drum.

Winch drums of the type mentioned have been put to use in many different applications and have particularly been in extensive use on board ships in connection with ordinary loading, trawling, towing and warping winches. Said hawsers are subjected to large pull, and accordingly it is of greatest importance that the hawser is treated gently when passing from one drum part to the other. It is consequently essential to avoid heavy stresses on the hawser due to bending forces exerted on the hawser during such transfer of the hawser from drum part to drum part. It is further important that wear and tear on the hawser is avoided as far as this is possible. In case tension is rising in the hawser at such cross-over portion on the drum, the hawser may also easily penetrate into underlaying layers between the separating flange and such underlaying layers of the hawser.

In U.K. Pat. No. 549,258 is suggested an arrangement to guide the hawser from one drum part to the other via a connecting bridge on one side of the separating flange to the top of such flange and along a further connecting bridge on the opposite side of the separating flange to the other drum part. By means of such arrangements it has been possible to cross the separating flange smoothly so that the hawser can be handled in controlled smooth manner.

In order to avoid damages on the hawser at the separating flange, it has hitherto been required the use of relatively complex manufacturing equipment, and a complex operation of machining the separating flange will be necessary.

An object of the present invention is to avoid the disadvantages which have encumbered priorly known embodiments of winch drums. More specifically, it is an object to avoid wear and tear and other damages on the hawser at the separating flange and to achieve such result by means of a winch drum arrangement based on a comparatively simple mode of production.

The winch drum of the present invention is characterised in that the separating flange is provided with a groove-carrying guiding device formed by a circular disc or disc section.

In a preferred embodiment, the circular arc of the guiding device is located in a plane forming an angle with the main plane of the separating flange, though it may, when necessary, be arranged parallel to the separating flange.

By such arrangement, it is relatively easy to manufacture a separately machined groove-carrying guiding device and to locate same in a desired position on the separating flange. By using a separate circular disc or disc section as guide element, the manufacturing operations including machining operations can be carried out in a simple manner, as such disc or disc section can be easily clamped in position to be machined by a rotary machine tool.

In case it is desirable to have as little friction as possible between the hawser and the guide element, a disc or a disc section can be incorporated in or on the separating flange and can be pivoted or oscillated as required. In case an adjustable disc section is used, this is arranged so as to oscillate a restricted circular arc between two stops.

In case it is desired to have an especially smooth curve on the guide element, use can be made of a semi-disc or of a greater or lesser section of a disc provided with a great curve diameter. In such cases the disc section can be permanently welded or otherwise suitably fastened directly to the separating flange.

The term of "disc section" is herein meant to comprise any suitable part of a rotary body such as a rim segment or the like of a disc body.

Further features of the invention will be apparent from the following description with reference to the accompanying drawings, wherein:

FIG. 1 is a side elevation of a winch drum with an adjustable disc located in the separating flange.

FIG. 2 is a section of the drum along a line A—A in FIG. 1 in between the separating flange and one of the side flanges.

FIG. 3 is a side elevation of a winch drum with a disc section located in a non-adjustable manner in the separating flange.

FIG. 4 is a section of the drum along a line B—B in FIG. 3 between the separating flange and one of the side flanges.

FIGS. 5 and 6 are views which show a winch drum wherein the disc or disc section, as the case may be, is arranged parallel to the separating flange and is located on the tension part of the drum.

In the embodiments illustrated in the drawings, a drum 10 is provided with two side flanges 11 and 12 and a separating flange 13 separating the drum in two drum segments 14 and 15. One drum segment 14 constitutes a tension part of the drum and is arranged to handle a hawser 16 in a single or in a few layers thereon, while the other drum segment 15 constitutes the storing part of the drum, to store the hawser in one or more layers. The hawser 16 as shown in dotted lines extends from the storing part 15 via a guide element 17 on the separating flange 13 to the tension part 14 of the drum.

Along the outer rim of the separating flange a peripheral flange is projecting with rib protrusions 19, 20 in opposite directions from the separating flange. The rib protrusions 19, 20 terminate flush with the guide element 17, so that the latter, which is separately produced by means of rotary machining operation, can be easily inserted in the separating flange, in an accurate manner. The rib protrusions 19, 20 will together with sloping guide surfaces 21, 22 in the separating flange ensure that the hawser is guided in an intended controlled manner from the guide element in position on either the tension part or the storing part of the drum.

FIGS. 5 and 6 show a pin or projection 26 and two pins or projections 27 and 27*a* which ensure that the hawser is guided in an intended controlled manner to the disc 17 and further therefrom into position on either the tension or the storing part of the drum. The pins or projections can be substituted by means of a rounding-off portion or notches in the separating flange (not illustrated).

FIGS. 1 and 2 show a separately manufactured guide element formed by a groove-carrying circular disc 17*a* which is pivotable on a shaft journal 23 in lugs 24, 25 fixed to the separating flange 13. In the illustrated embodiment, the disc 17*a* terminates a short distance radially outside the peripheral surface of the tension part respectively the storing part of the drum. This enables the radially innermost part of the separating flange to provide lateral support for one or more layers of hawser, while the disc 17*a*, which is terminating a short radial distance outside this or these layers, is prevented from direct contact therewith.

It is, however, also possible to allow the disc 17*a* to extend to the peripheral surface of the drum, as in cases where a particularly large disc diameter is required or in cases where it is desirable to locate the hawser close to the circumference of the separating flange.

By the use of an adjustble disc as guide element for the hawser, the latter may be prevented from friction at the cross-over location between the storage part and the tension part of drum. Pivoting of the disc can further ensure a positive guiding effect on the hawser at the said cross-over location.

FIGS. 3 and 4 show a guide element in the form of a semi-disc 17*b*. The semi-disc 17*b* is arranged to oscillate between two suitable positions defined by stops shown in detail, or can be fitted in a non-adjustable position by means of welds.

By using such a semi-disc or other sectional part of a disc, it is possible to create a relatively large radial distance between the disc and the surface of the drum, i.e. the peripheral surface of the storage or tension part of the drum. A design of this type is especially advantageous when the hawser is stored in several layers on the tension part 14. In terms of manufacture, there is little to save between making a whole disc or part of one, since either can be worked by means of rotary machine tools when suitably clamped. It is likewise possible in either case to attain the desired guiding effect on the hawser.

Another advantage of using a part-disc is that a large bending radius can be attained by allowing the centre of the disc to lie appropriately close to the peripheral surface of the storing or tension part of the drum.

What we claim is:

1. In an elongated winch drum having flanges at opposite ends thereof, and a further flange at a location intermediate said opposite ends for separating said drum into two drum segments, a device for guiding hawser during the transfer thereof from one drum segment to the other, said device comprising a disc member mounted on said further flange, there being a slot formed in said further flange at an angle with respect to the main plane of the separating flange, said disc member being received in said slot, said disc member having a grooved edge in which the hawser moves during the transfer thereof.

2. A device in accordance with claim 1 comprising means defining opposed mounting surfaces carried on said further flange, said mounting surface comprising structure defining said slot, said disc member being supported on said mounting surfaces.

3. A device in accordance with claim 2 wherein said disc member is rotatably supported on said mounting surfaces.

* * * * *